US006499959B1

(12) United States Patent
Reluzco et al.

(10) Patent No.: US 6,499,959 B1
(45) Date of Patent: Dec. 31, 2002

(54) STEAM TURBINE HIGH STRENGTH TANGENTIAL ENTRY CLOSURE BUCKET AND RETROFITTING METHODS THEREFOR

(75) Inventors: George Ernest Reluzco, Schenectady; Rong-Shi Paul Chiu, Glenmont, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/639,047

(22) Filed: Aug. 15, 2000

(51) Int. Cl.[7] ..... F01D 5/14
(52) U.S. Cl. ..... 416/241 R; 416/215; 416/219 R
(58) Field of Search ..... 416/215, 219 R, 416/220 R, 221, 204 A, 241 R

(56) References Cited

U.S. PATENT DOCUMENTS 3,088,708 A * 5/1963 Feinberg ..... 416/215
3,120,277 A * 2/1964 Brown et al. ..... 416/215
3,721,506 A * 3/1973 Anderson ..... 416/215
4,400,137 A * 8/1983 Miller et al. ..... 416/221
4,878,811 A * 11/1989 Jorgensen ..... 416/215
5,062,769 A * 11/1991 Ortolano ..... 416/217
5,823,745 A * 10/1998 Anderson, III et al. . 416/213 R
6,085,417 A * 7/2000 Anderson, III et al. .... 29/889.1

* cited by examiner

*Primary Examiner*—F. Daniel Lopez
*Assistant Examiner*—James M McAleenan
(74) *Attorney, Agent, or Firm*—Nixon & Vanderhye

(57) ABSTRACT

A steam turbine wheel has a male dovetail projecting about its peripheral margin and a gap in the margin. Buckets having bases with complementary female dovetails are disposed in the gap and register with the male dovetail of the wheel, enabling the buckets to slide about the wheel into positions stacking the bases of the buckets against one another. The final three buckets including a closure bucket are disposed about the wheel margin with two buckets straddling the closure bucket secured to the wheel margin by the dovetails. The closure bucket is secured to the straddling buckets by axially extending pins. The closure and straddling buckets, as well as the pins, are formed of materials having a higher creep rupture strength than the materials forming the remaining buckets, enhancing the capability of the closure bucket to withstand high temperature and stresses over time without creep.

16 Claims, 2 Drawing Sheets

STEAM TURBINE HIGH STRENGTH TANGENTIAL ENTRY CLOSURE BUCKET AND RETROFITTING METHODS THEREFOR

BACKGROUND OF THE INVENTION

The present invention relates to steam turbine buckets and particularly to a high strength steam turbine closure bucket for avoiding creep elongation.

Steam turbine buckets are currently designed using an identical material for all of the buckets for a particular stage of the turbine. The buckets are commonly formed of a Type 403 or 422 stainless steel, depending upon the stage temperature. Steam turbine buckets are also often designed for installation on the turbine wheel in a tangential direction. Consequently, the base or root of the steam bucket typically has a female dovetail configuration. The peripheral margin of the turbine wheel has a generally complementary male dovetail configuration and an insertion gap to facilitate installation of the buckets. For example, each bucket is assembled onto the rotor wheel by first locating the bucket base in the gap. Once the dovetails on the bucket and wheel are aligned, the bucket is displaced along the periphery of the wheel in a tangential direction. Additional buckets are similarly installed on the wheel and the roots or bases of the buckets stack against one another on the wheel margin. The installation process proceeds until the entire margin of the wheel, with the exception of the gap, is filled with buckets. The last bucket to be assembled to the wheel is called the closure bucket. The closure bucket typically does not have a dovetail. The closure bucket root or base may, however, be recessed to balance its weight with the weights of the other buckets about the wheel to balance the wheel. Because there is a gap in the dovetail margin of the wheel, the closure bucket must be secured to the adjacent buckets, i.e., the two buckets which straddle the gap and the closure bucket, in order to secure the closure bucket to the wheel. Typically, the closure bucket is attached to the adjacent buckets by pins extending in an axial direction engaging through the root or base portions of the adjacent buckets and the closure bucket.

It will be appreciated that during operation, the centrifugal load of the closure bucket is carried by the adjacent buckets through the pins. The applied loads on the closure and adjacent buckets are thus not uniform. High localized stresses are encountered at the location of the securement between the closure bucket and the two adjacent wheels, i.e., along the slots receiving the pins and the pins themselves. Consequently, creep and permanent deformation of the closure bucket and/or the adjacent buckets may occur after a period of operation at high temperatures and high centrifugal loads. For example, such high temperatures and loadings may occur in the reheat section of an intermediate stage turbine. As a result, the closure bucket may tend to elongate at its base or root in response to these high temperatures and stresses over time, with the result that the slot or hole for receiving the pins may elongate in a radial outward direction. Consequently, there is a need for an increase in the load-carrying capacity of at least the closure bucket in a steam turbine.

BRIEF SUMMARY OF THE INVENTION

In accordance with a preferred embodiment of the present invention, the creep rupture strength of the closure bucket is increased in relation to the creep rupture strength of the majority of the remaining buckets disposed on the wheel. To increase the load-carrying capability of the closure bucket, the material of the closure bucket has a higher creep rupture strength than the majority of the buckets on the wheel. The closure bucket, for example, may be formed of a nickel-based alloy, while the majority of the remaining buckets are formed of a stainless steel. Further, because of the possibility of high local stresses at the juncture of the closure bucket and adjacent buckets, and in the pins, the pins and the two buckets straddling the closure bucket are likewise formed of a material having a higher creep rupture strength than the creep rupture strength of the remaining buckets about the wheel. Thus, a plurality of buckets about the wheel are formed of stainless steel and the closure bucket and preferably the two adjoining buckets and pins are formed of a higher strength material such as nickel-based alloy to avoid creep rupture.

In a preferred embodiment according to the present invention, there is provided a steam turbine wheel for use in a steam turbine, the wheel having a plurality of tangential entry buckets having tangentially extending dovetails for attachment to the wheel, the wheel having a generally complementary-shaped dovetail about a peripheral margin thereof and a gap in the margin for receiving the plurality of buckets and a closure bucket, the closure bucket being formed at least in part of a material having a creep rupture strength greater than the creep rupture strength of at least a majority of the plurality of buckets.

In a further preferred embodiment according to the present invention, there is provided a method of avoiding creep rupture strength failure of a first closure bucket in a tangential bucket entry turbine wheel having a peripheral dovetail-shaped margin and a plurality of tangential entry buckets having complementary dovetail-shaped bases secured to the wheel margin wherein the plurality of buckets and the first closure bucket are formed of the same materials, comprising the steps of removing the first closure bucket from the turbine wheel and securing a second closure bucket formed at least in part of a material having a higher strength than the material of the removed closure bucket to the turbine wheel in place of the first removed closure bucket.

DETAILED DESCRIPTION OF THE INVENTION

Figure 1:
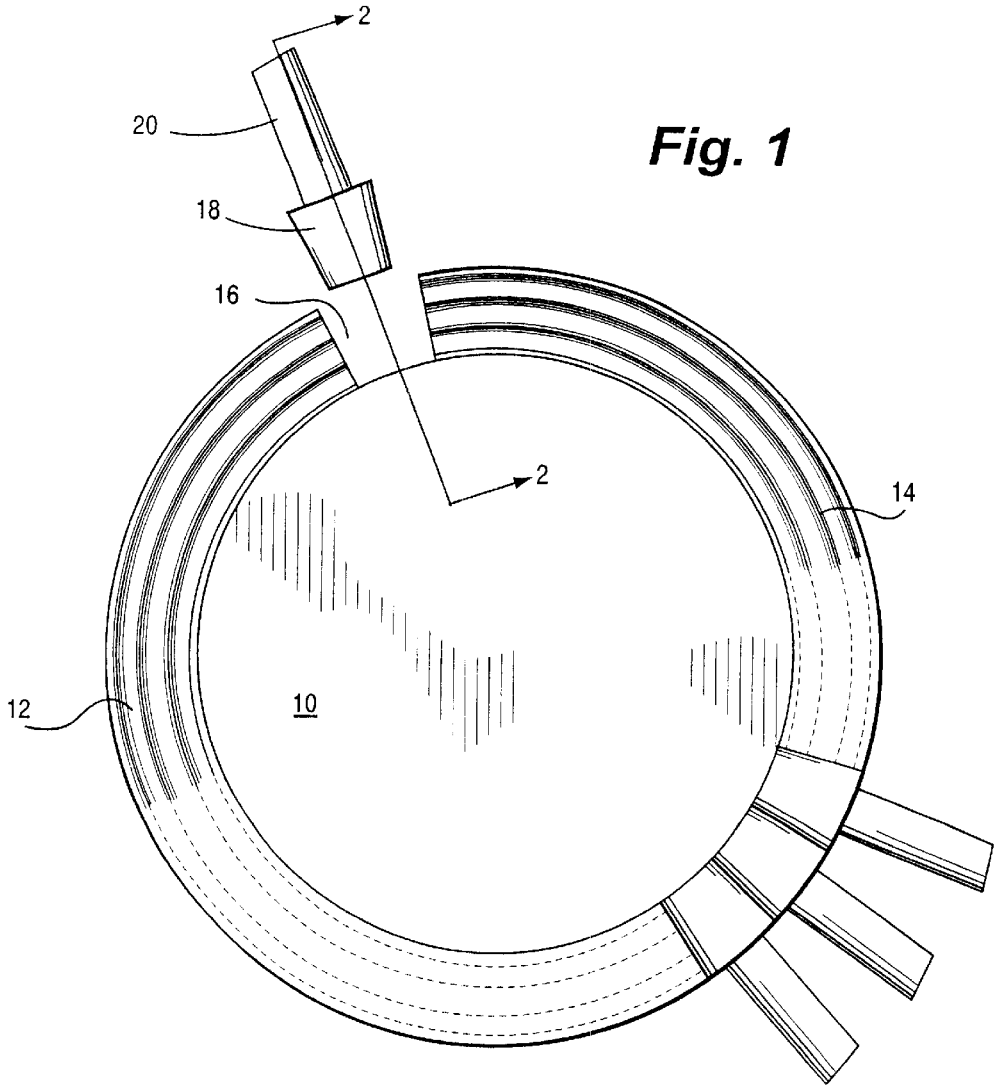
FIG. 1 is a schematic illustration of a steam turbine wheel of the tangential entry type illustrating the manner of installation of the buckets about the wheel.
Figure 2:
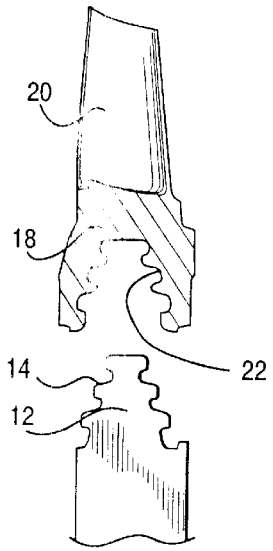
FIG. 2 is a cross-sectional view thereof taken generally about on line 2—2 of FIG. 1.

Referring now to the drawing figures, particularly to FIG. 1, there is illustrated a steam turbine wheel 10 having a peripheral margin 12 specifically configured to receive generally complementary-shaped bases or roots of buckets to secure the buckets to the wheel. Preferably, the peripheral margin 12, as illustrated in FIG. 2, has a circumferentially extending male dovetail 14. The margin 12 containing the dovetail 14 extends substantially throughout the entire circumference of the wheel 10, except for a gap 16 illustrated in FIG. 1. The gap 16 is dimensioned to receive the base or root 18 of a bucket 20, the base or root 18 having a female dovetail 22 (FIG. 2) generally complementary to the male dovetail 14.

It will be appreciated from the foregoing description of the wheel 10 and particularly its peripheral margin 12, as well as the roots or bases 18 of the buckets 20 that the buckets are inserted onto and secured to the wheel by tangential entry onto the margin of the wheel. Each bucket, with the exception of the final closure bucket, is thus inserted into the gap 16 to tangentially align the female dovetail 22 with the male dovetail 18 such that the bucket can slide along the dovetail 14 about the periphery of the wheel into a final position. It will be appreciated that all buckets, except for the final closure bucket, may be secured to the wheel in this manner, with the bases or roots of the buckets adjoining, i.e., stacked against one another about the wheel. The final closure bucket, however, cannot be secured directly to the wheel due to the absence of the male dovetail along the wheel at the gap 16.

Figure 3:
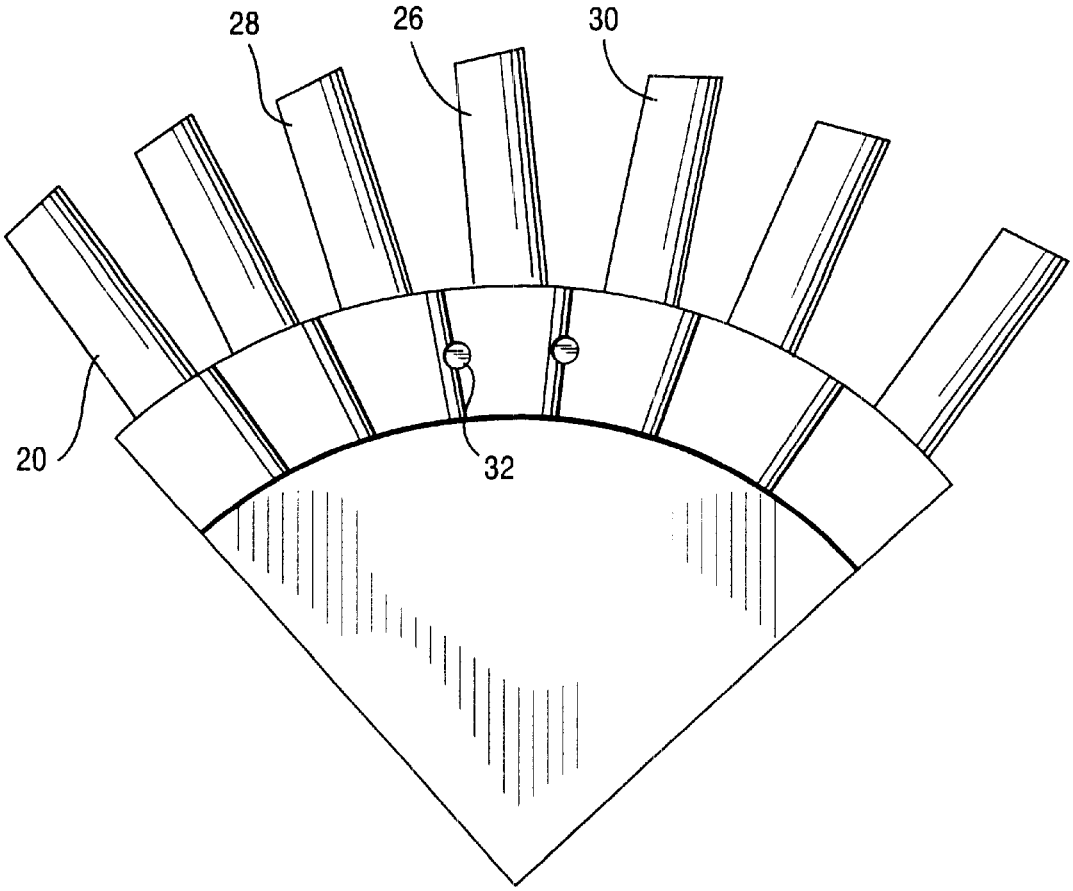
FIG. 3 is a partial end elevational view illustrating the wheel and the closure bucket in the gap of the margin of the wheel and secured to adjoining buckets.

To secure the closure bucket 26 as illustrated in FIG. 3 to the wheel 10, the closure bucket 26 is secured to the two adjacent buckets 28 and 30 by pinned connections. That is, the sides of the base of the closure bucket, as well as registering sides of the bases of the adjacent buckets 28 and 30, have grooves for receiving axially directed pins 32. In this manner, the closure bucket is secured against radial outward displacement relative to the wheel. It will also be appreciated that because of this type of securement to the adjacent buckets, localized stresses in the region of the securement, i.e., the grooves and pins, may cause creep failure during operation at high temperature and stresses over time. Consequently, the grooves may elongate in a radial direction when subjected to high temperature and stress, essentially elongating the closure bucket relative to the other buckets about the wheel.

To avoid creep failure, the closure bucket and preferably the two adjoining buckets are formed of a material having a higher strength, e.g., a higher creep rupture strength than the creep rupture strength of material forming the remaining buckets. For example, the remaining buckets may be typically formed of a stainless steel. The material of the closure and adjoining buckets, however, may comprise a nickel-based alloy and more particularly and preferably an Inconel-718 nickel-based alloy. Additionally, the pins 32 are preferably formed of a material having a higher creep rupture strength than the creep rupture strength of the remaining buckets. Thus, the pins are preferably formed of a similar material as the closure and adjacent buckets, although it will be appreciated that the pins may be formed of a different material having a higher creep rupture strength than the creep rupture strength of the stainless steel buckets.

It will also be appreciated that the higher creep rupture strength closure and adjacent buckets as well as the pins of the present invention may be used in the original equipment manufacture of a steam turbine wheel. Also, closure and adjacent buckets formed of higher creep rupture strength than the creep rupture strength of the remaining wheels may be utilized as retrofits in after-market steam turbines as necessary or desired. For example, should creep elongation in one or more closure buckets in an existing steam turbine be detected during its lifespan during an outage, the turbine can be taken out of service and the existing closure and adjoining buckets and pins replaced with the new higher strength closure and adjoining buckets and pins. Replacement of extant closure and adjacent buckets and pins may also be accomplished during scheduled outages as a precaution.

To retrofit an extant steam turbine wheel, for example, during a turbine outage, the closure bucket, typically formed of stainless steel, of the extant turbine wheel is removed by removing the axial pins 32. Preferably, the buckets on either side of the removed closure bucket are likewise removed by sliding the buckets into the gap 16 and removing the buckets from the gap. A second pair of buckets each having the female dovetail 22 and formed of a material having a higher creep rupture strength than the creep rupture strength of the removed buckets are then inserted one after the other into the gap and onto the peripheral margin of the wheel. A new closure bucket formed of a material having a higher creep rupture strength than the creep rupture strength of the removed closure bucket is then inserted into the gap. Pins similarly formed of a higher creep rupture strength material than the material of the removed pins are inserted into the aligned axial openings to retain the new or second closure bucket on the wheel. Consequently, the wheel may be retrofitted with the buckets of higher creep rupture strength as part of scheduled maintenance or upon detection of creep in the extant closure and adjoining buckets.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A steam turbine wheel for use in a steam turbine, said wheel having a plurality of tangential entry buckets having tangentially extending dovetails for attachment to said wheel, said wheel having a generally complementary-shaped dovetail about a peripheral margin thereof and a gap in the margin for receiving said plurality of buckets and a closure bucket, said closure bucket being formed as part of an original equipment manufacturer or as a replacement closure bucket, said closure bucket being formed at least in part of a material having a creep rupture strength greater than the creep rupture strength of at least a majority of said plurality of buckets.

2. A steam turbine wheel according to claim 1 wherein said closure bucket is straddled by and secured to two adjacent buckets.

3. A steam turbine wheel according to claim 2 wherein said two adjacent buckets are formed at least in part of a material having a creep rupture strength greater than the creep rupture strength of said majority of said plurality of buckets.

4. A steam turbine wheel according to claim 3 wherein said two adjacent buckets have tangentially extending dovetails and engage a portion of the complementary-shaped dovetail margin of said wheel.

5. A steam turbine wheel according to claim 2 including pins connecting said closure bucket and said two adjacent buckets.

6. A steam turbine wheel according to claim 1 wherein said majority of said buckets are formed of stainless steel and said closure bucket is formed of a nickel-based alloy material.

7. A steam turbine wheel according to claim 1 wherein said majority of said buckets are formed of stainless steel and said closure bucket is formed of an Inconel-718 nickel-based alloy material.

8. A steam turbine wheel according to claim 1 wherein said closure bucket is straddled by and secured to two adjacent buckets, said majority of said buckets being formed of stainless steel and said closure bucket being formed of a nickel-based alloy material.

9. A steam turbine wheel according to claim 1 wherein said closure bucket is straddled by and secured to two adjacent buckets, said two adjacent buckets being formed at least in part of a material having a creep rupture strength greater than the creep rupture strength of said majority of said plurality of buckets, said majority of said buckets being formed of stainless steel and said closure bucket and said two adjacent buckets being formed of a nickel-based alloy material.

10. A steam turbine wheel according to claim 1 wherein said closure bucket is straddled by two adjacent buckets, a pin connecting said closure bucket and each of said two adjacent buckets, said majority of said buckets being formed of stainless steel and said closure bucket and said pins being formed of a nickel-based alloy material.

11. A steam turbine according to claim 10 wherein said two adjacent buckets are formed at least in part of a material having a creep rupture strength greater than the creep rupture strength of said majority of said plurality of buckets.

12. A method of avoiding creep elongation failure of a first closure bucket in a tangential bucket entry turbine wheel having a peripheral dovetail-shaped margin and a plurality of tangential entry buckets having complementary dovetail-shaped bases secured to said wheel margin wherein said plurality of buckets and said first closure bucket are formed of the same materials, comprising the steps of:

removing the first closure bucket from the turbine wheel; and securing a second closure bucket formed as part of an original equipment manufacturer or as a replacement closure bucket and formed as part of an original equipment manufacture or as a replacement closure bucket and formed at least in part of a material having a higher strength than the material of the removed closure bucket to the turbine wheel in place of the first removed closure bucket.

13. A method according to claim 12 including, subsequent to removing said first closure bucket, removing from said wheel each of two buckets previously straddling the first closure bucket and, prior to securing the second closure bucket to said wheel, securing to the wheel two additional buckets formed at least in part of a material having a higher strength than the material of the two buckets removed from the wheel to the wheel, such that said two additional buckets straddle said second closure bucket upon securement of said second closure bucket to said wheel.

14. A method according to claim 13 including securing the second closure bucket to each of the two buckets formed of the higher strength material.

15. A method according to claim 14 including, prior to removing said first closure bucket, removing pins securing said first closure bucket and said two buckets straddling said first closure bucket from said wheel, and pinning said second closure bucket to said two buckets formed at least in part of said higher strength material by pins formed of a higher strength material than the material of said removed pins.

16. A method according to claim 15 including forming each of said second closure bucket, said two additional buckets and said pins at least in part of a higher creep rupture strength material than the material forming the first closure bucket, said two removed buckets and said removed pins.

* * * * *

UNITED STATES PATENT AND TRADEMARK OFFICE

CERTIFICATE OF CORRECTION

PATENT NO. : 6,499,959 B1 
DATED : December 31, 2002
INVENTOR(S) : Reluzco et al.

It is certified that error appears in the above-identified patent and that said Letters Patent is hereby corrected as shown below:

Column 4,
Line 33, kindly delete "manufacturer" and insert -- manufacture -- therefor.

Column 5,
Line 18, kindly delete "elongation" and insert -- rupture strength -- therefor.
Line 27, kindly delete -- as part of an original equipment manufacturer or as a replacement closure bucket and formed -- after "second closure bucket formed".

Signed and Sealed this

Fifteenth Day of July, 2003

JAMES E. ROGAN
*Director of the United States Patent and Trademark Office*